United States Patent [19]

Nicholls

[11] 4,216,960

[45] Aug. 12, 1980

[54] TETHERED BALL TENNIS PRACTICE APPARATUS

[76] Inventor: Oswald C. J. Nicholls, 294 Warrigal Rd., Burwood, Victoria, Australia

[21] Appl. No.: 884,174

[22] Filed: Mar. 7, 1978

[30] Foreign Application Priority Data

Mar. 8, 1977 [AU] Australia ..... PC9331
Aug. 8, 1977 [AU] Australia ..... PD1131

[51] Int. Cl.[2] ..... A63B 69/38
[52] U.S. Cl. ..... 273/29 A; 273/58 C
[58] Field of Search ..... 273/26 E, 29 A, 95 A, 273/58 C, 200 R, 200 A, 185 G, 184 B, 198; 119/121, 122, 120, 119

[56] References Cited

U.S. PATENT DOCUMENTS

| | | | |
|---|---|---|---|
| 223,872 | 1/1880 | Ashford | 122/119 |
| 830,581 | 9/1906 | Fleischman | 273/58 C |
| 861,506 | 7/1907 | Doyle | 273/26 E |
| 883,058 | 3/1908 | Sprague | 273/200 R |
| 1,708,796 | 4/1929 | Lawrence | 273/29 A |
| 2,772,882 | 12/1956 | Anson | 273/26 E |
| 2,812,743 | 11/1957 | Dustin | 119/121 |
| 3,658,330 | 4/1972 | Maestracci | 273/29 A |
| 3,804,409 | 4/1974 | Schachner | 273/58 C |
| 3,924,855 | 12/1975 | Pretorius | 273/95 A |
| 4,113,257 | 9/1978 | Moffatt | 273/200 R |

FOREIGN PATENT DOCUMENTS

| | | | |
|---|---|---|---|
| 477369 | 1/1953 | Italy | 273/26 E |
| 140131 | 8/1930 | Switzerland | 273/29 A |
| 18311 | 2/1929 | United Kingdom | 273/95 A |
| 350241 | 6/1931 | United Kingdom | 273/26 E |

*Primary Examiner*—Richard C. Pinkham
*Assistant Examiner*—T. Brown
*Attorney, Agent, or Firm*—Fleit & Jacobson

[57] ABSTRACT

Games practice device having two upright spaced poles and an elastic line formed in three sections extending from a common junction. Ends of two sections are formed into loops engaged around cylindrical surfaces of end connectors which provide couplings to the upper ends of the poles. A ball is suspended from the third line section. The line sections are formed from a single length of elastic material, knotted to form the three line sections. The poles have apertured outward peripheral flanges at the lower ends so that hooked stays can be engaged at one end in the apertures and can be pressed at the other ends into a ground surface to hold the poles upright.

16 Claims, 8 Drawing Figures

TETHERED BALL TENNIS PRACTICE APPARATUS

BACKGROUND OF THE INVENTION (i) Field of the Invention

This invention relates to a ball game practice device particularly, but not exclusively, for use in tennis practice.

(ii) Prior Art

Applicant is aware of the following prior publications relating to games practice devices:

1. Australian Patent specification 18311/29.
2. U.S. Pat. No. 3,658,330.
3. U.S. Pat. No. 3,924,855.

These disclose ball game practice devices comprising a ball, a line having first, second and third sections extending from a common junction to respective outer ends thereof, at least said first and second sections being elastic, two elongate members positionable to extend from a ground surface in upright spaced disposition, first and second connection means for connecting the outer ends of the first and second sections to the respective elongate members and third connection means for connecting the outer end of the third section to said ball whereby, in use of the device with the elongate members positioned in said upright spaced disposition and the outer ends of said first and second sections connected to the respective elongate members, the ball is elastically suspended by said line between the said elongate members, the ball then being handingly suspended from the junction of said first and second sections through said third section. A player may then strike the ball with a tennis racquet for example, the elastic line then returning the ball after each stroke to the player.

One difficulty with devices of the above kind is that, in use, the elastic first and second sections tend to have a limited life, because of the substantial strain imposed on them in use. Such strain is particularly likely to cause failure of the first and second sections at the locations where they couple to the respective first and second connection means. If, for example, securement of the first and second sections to the respective first and second connection means is effected only by tying of the sections, constant rubbing of the sections against the connection means, in use of the device, will rapidly cause damage to the surface of the line sections, leading to premature failure. One object of the present invention is to provide a connection arrangement which is less likely to cause such damage and premature failure.

BRIEF DESCRIPTION OF THE INVENTION

Generally, the invention is characterised in that the first and second connection means include loops formed at the outer ends of said first and second sections and respective first and second elements presenting cyclindrical outer surfaces of substantially less circumferential dimension than the unstretched length of the material forming the first and second loops; said first and second loops being engaged around the cylindrical surfaces of the respective first and second elements and the first and second connection means further including first and second respective retaining portions serving to prevent the first and second loops from becoming disengaged with the said first and second elements respectively. The first and second connection means may include respective first and second eyelets each eyelet defining a respective said element and retaining portion. Preferably the connection means in each case then further includes a loop member secured to the respective elongate member and a ring, each ring providing connection between the respective said element and loop member.

Preferably, however, said first element and first retaining portion are formed on a first body of plastics material and the second element and retaining portion are formed on a second body of plastics material, the said first and second connection means respectively including first and second rings passing through apertures in the first and second bodies and respectively passing through apertures in connection portions of respective ones of said two elongate members. Preferably, too, the said apertures are of greater dimension than the cross-sectional dimension of the said rings. The rings may be substantially rigid, with the cross-sectional area of the apertures of said connection portions being at least several times the cross-sectional size of the material forming the rings.

In a particularly preferred embodiment, each said retaining portion is arranged to present a concavely curved surface which extends around, and in generally parallel spaced relationship to, the respective cylindrical surface, and a pair of opposed surfaces extending transversely to the axial direction of the respective cylindrical surface; the transversely extending surfaces bridging the curved surface and cylindrical surface so that each said body defines a circular tunnel, said tunnel having a side aperture, formed through the curved surface, so that the associated loop extends, from the location at which it joins to the remainder of its line section into the said tunnel, around the cylindrical surface, exteriorally of the tunnel and thence back to the said location. Preferably each said tunnel is of sufficient size that it lightly clamps the material forming the associated loop where that material is within the tunnel, when the material is unstretched, but is such that, when the material undergoes dimensional change in cross-section pursuant to stretching thereof, such clamping is at least partly released.

Each said body may be formed of two-part construction, a first part having the said element formed thereon with an outstanding peripheral flange therearound at one end and with said aperture formed therein as a bore concentric with the cylindrical surface of that element, and a second part comprising an annular member fittable to the end of the said element remote from said flange so that when the two parts are so fitted together the said pair of surfaces are defined on respective opposed surfaces of the flange and annular member, one of said annular member and flange having a peripheral rim defining the associated said curved surface, which rim, in the assembled condition of the first and second parts, bridges the said flange and annular member. Preferably the rim is on the annular member and has a discontinuity so that it extends substantially, but not completely, around the periphery of the annular member whereby in the assembled condition of the first and second parts, the said aperture is defined at the location where the discontinuity in said rim is present. Preferably, said parts form cooperating components of a snap fastener so that a said loop can be positioned over a said element and the assembly completed by snapping said annular member onto the first part. Thus, each said element may have, at the end remote from said flange, at least one outward projection over which a central opening of the annular member must pass to engage the first and second parts together, the central opening being of such dimension that it can only be passed over said projection by elastic deformation of both of said first and second parts, but reverts to its undeformed state upon such passing over. Said projection may be in the form of a peripheral ridge. Preferably the spacing between said ridge and said flange is such as to effect said clamping of the loop in the assembled body by pressing of the said opposed surfaces against the loop material.

Preferably the third connection means includes a flexible but non-elastic element such as a leather element which interconnects the ball and an elastic portion of the third section extending away from said junction. The non-elastic element may be in the form of a loop which, where said ball is a tennis ball, passes at one end through the nap of the ball, but not into the interior of the ball casing and which is secured at the other end to said elastic portion.

The first and second line sections may be formed of single strands of fine latex rubber material and the said elastic portion may be formed of two side-by-side strands of such material, or in any event so formed that its elasticity is not as great as the elasticity of the first and second sections.

The said elongate members may be in the form of rods and may, for example, be demountable for transportation. The rods are preferably provided with means for securing them to a ground surface, such as by means of stays interconnecting the rods and able to penetrate a turf or like ground surface. Alternatively, the lower ends may be spiked or may be provided with means enabling them to fit into a socket secured to the ground surface. Again, they may be provided with flexible lines securable between upper of lower portions thereof and ground pegs.

In another aspect of the invention, the said first and second sections are formed from material having an elastic constant in the range 1.1 to 1.7 Newtons per meter. Preferably, the spring constant is substantially 1.4.

BRIEF DESCRIPTION OF THE DRAWINGS

The invention is further described with reference to the accompanying drawings in which.

DETAILED DESCRIPTION

Figure 1:
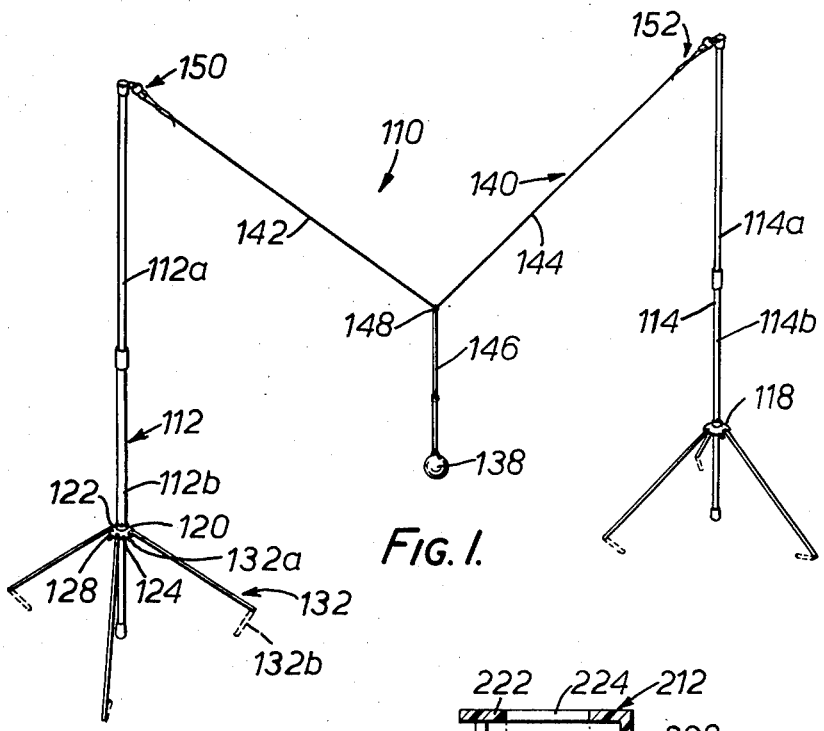
FIG. 1 is a perspective view of a games practice device constructed in accordance with the invention.

The device 110 shown in FIGS. 1 to 5 includes two upright rods 112, 114 arranged in spaced parallel relationship and extending from ground surface. The rods are of circular cross-section and are fitted at locations towards lower ends thereof with plastics collars 118, 120. These are of like configuration each having a boss portion 122 with an outstanding lower peripheral flange 124. The collars 118, 120 have central bores through which the respective rods 112, 114 pass, the collars being heat shrunk onto the rods so that they are fixedly located thereon.

The flanges 124 of collars 118, 120 each have a plurality of equi-spaced apertures 128 therethrough. Three elongate wire stays 132 are provided for each collar 118,120, these having sharply hooked upper ends 132*a* and generally right angled bent opposite ends 132*b*. The upper ends 132*a* of the stays are hooked downwardly through respective ones of the apertures 128 and the ends 132*b* are pressed into the ground surface at locations around the rod axes so that each rod has a series of equi-spaced ground supports around its base provided by the rods associated therewith.

The rods 112, 114 may each be of approximately six feet in length and spaced apart about 9 feet.

A tennis ball 138 is supported between the two rods 112, 114 by means of a line 140. This has first, second and third sections 142, 144, 146 respectively, the three sections extending from a common junction 148 to outer ends thereof. Sections 142, 144 are formed from single threads of latex rubber material of fine gauge, of the order of 20 to 22 SWG which are, in their unextended condition of length about 30 inches. This material has a spring constant of approximately 1.41 Newtons per meter and has been found to provide very satisfactory performance.

The outer ends of the line sections 142, 144, are secured to the respective rods 112, 114 by connections 150, 152 respectively. These connections are identical and only the connection 152 is described in detail with particular reference to FIGS. 2 to 5. This connection includes a two-part connector 202, engaged with a loop 200 formed at the outer end of line section 144, an end piece 204 secured to the upper end of rod 114 and a ring 205 interconnecting connector 202 and end piece 204. Loop 200 is formed by taking approximately the last few inches of the material forming line section 144 and tying it back on the remainder of the line section at first and second locations 206, 208 respectively. The loop 200 then extends from first location 206 and contains about 3 inches of material. At the place between locations 206 and 208 there is formed a double thickness of material in the line section 144. Loop 200 is connected to the connector 202 as described in detail later. The end piece 204 is a plastics moulding of cup-shaped configuration fitted over the upper end of rod 114 and having an integrally formed side loop portion 204*a*. Ring 205, which may conveniently comprise a key ring, is engaged through loop portion 204*a* and through a bore 218 in connector 202.

Connector 202 is of moulded slightly resilient plastics material and comprises a first part 210 and a second part 212. First part 210 defines a central cylindrical element 214 and has an outwardly extending peripheral flange portion 216 at one axial end. The bore 218 is provided in part 210 and is coaxial with element 214. An outwardly projecting peripheral ridge 220 of slightly greater diameter than element 214 is provided at the end of the element remote from flange 216.

Part 212 of connector 202 comprises a planar annular portion 222 with a central opening 224 therein. Opening 224 is generally circular but has four outwardly directed radial notches 226 at equi-spaced locations on its periphery, which notches divide portion 222 into four separated segments 222a at the margin thereof around opening 224. A downwardly depending rim portion 228 of part 212 extends from the periphery of portion 222. This extends approximately three quarters of the way around the periphery of portion 222 but is interrupted over the remainder of the periphery of the portion 222 to form two opposed end edges 228a,228b of the rim.

Figure 4:
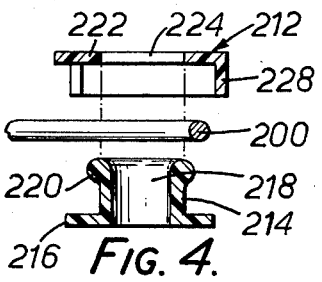
FIG. 4 is a cross-sectional view of the fastener of FIG. 3 illustrating the manner of assembly of the two parts thereof.
Figure 3:
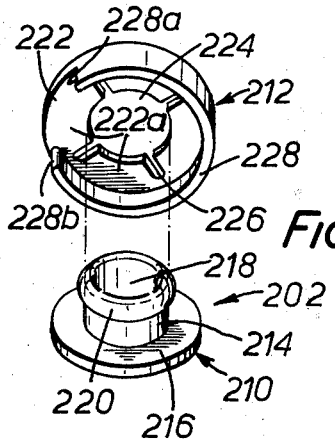
FIG. 3 is an enlarged perspective view of a two-part fastener incorporated into the device of FIG. 1, the parts being shown separated.
Figure 5:
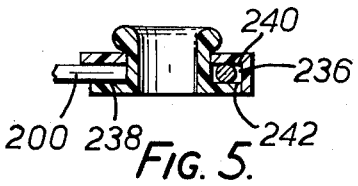
FIG. 5 is a cross-sectional view like FIG. 4 but showing the fastener in the assembled condition.

As best shown in FIGS. 4 and 5, connector 202 is assembled onto loop 200 by first placing the loop over cylindrical element 214. The section 144 may be lightly stressed so that the loop engages the outer cylindrical surface of element 214 around most of its periphery and then extends in two substantially straight runs to location 206. With the loop so positioned, and between ridge 220 and flange 216, part 212 is joined to part 210 by passing element 214 through opening 224. Opening 224 is of diameter such that it is a neat fit over the outer surface of element 214 and deformation of part 212 is thus necessary in order to pass the opening 224 over the ridge 220. However, the resilient nature of the plastics parts readily permits such deformation, particularly since the provision of the notches 226 around the opening 224 permits relatively easy resiliently opposed movement of the separated segments 222a. During this movement, the rim 212 passes over the periphery of flange 216 so that the flange neatly fits therearound. Then, the connector 202 forms, around the outer surface of element 214, a circular tunnel 236 which is substantially closed, but open to the exterior of the body via an opening 238 formed at the location of the discontinuity in the rim 228. This opening has opposite sides formed by the edges 228a, 228b of rim 228. The loop 200 passes into the tunnel 236 via opening 238 and thence within tunnel 236 around element 214. The annular portion 222 of part 212 and the flange 216 of part 210 present opposed generally annular surfaces 240, 242 of tunnel 236. The connector is so constructed that the spacing between ridge 220 and flange 216 is such that, in the assembled condition, these opposed surfaces are so positioned as to somewhat compress the material forming loop 200.

Figure 2:
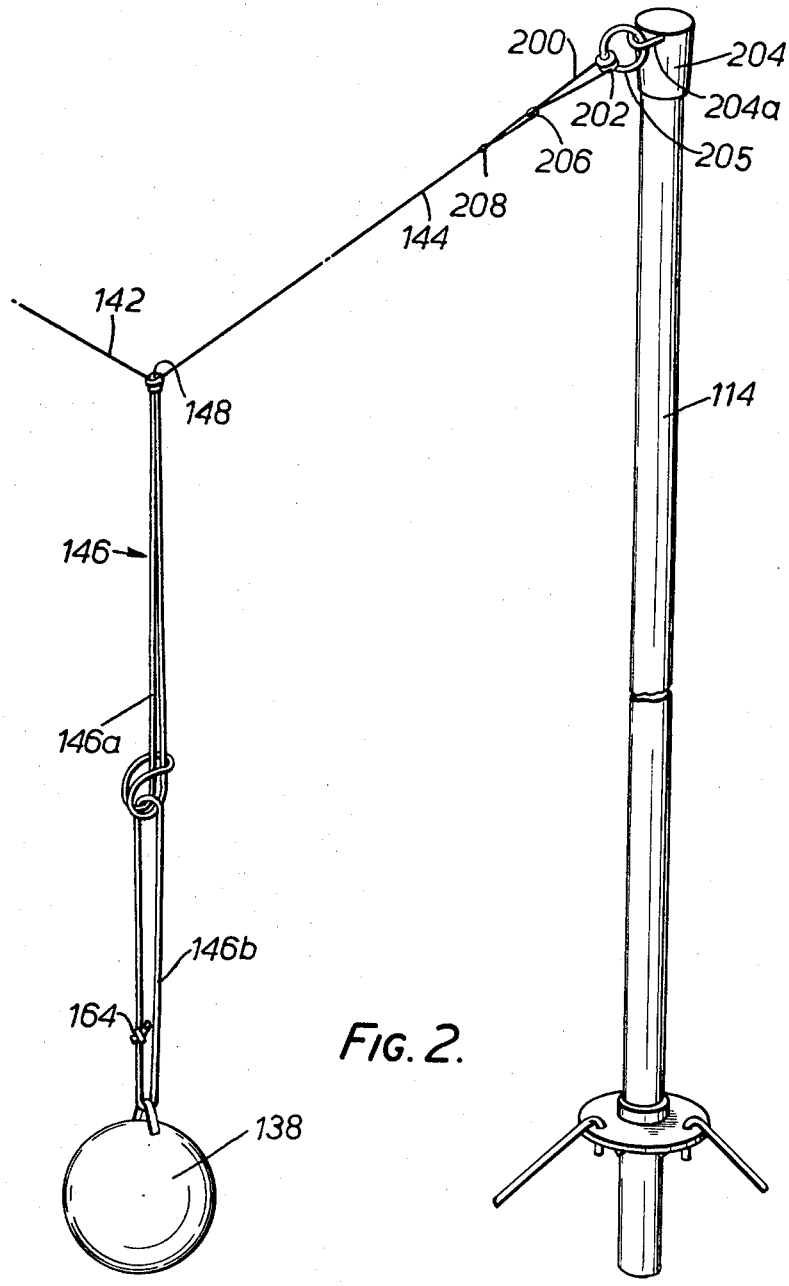
FIG. 2 is an enlarged perspective view of the device of FIG. 1.

Line section 146 comprises a first portion 146a of two threads of the same elastic material used for forming sections 142, 144. Portion 146a is about 12" in length and is secured at one end, as by knotting, at the junction 148. A second portion 146b of section 146 comprises a loop of thin leather strapping which is looped at one end to the section 146a and at the other end through the nap of the ball 138. In this connection, the leather strap forming portion 146b is first provided as a length of leather and the nap of the ball 138 is pared away from the casing of the ball by passing a piercing tool through the nap close to the ball casing to form an aperture. The strapping is then passed through this aperture and through a looped end of portion 146a and tied with a knot 164 to form the strapping loop as shown in FIG. 2. It has been found that this method of securement provides good attachment to the ball without causing alteration of the normal bounce characteristics thereof which may occur if the casing itself is pierced. Portion 146b may be of length about 8" and formed of relatively thin leather strap about ⅛" wide and about 1/32" thick.

Rods 112 and 114 may be formed in two demountable sections 112a, 112b, 114a, 114b respectively. Thus, adjacent ends of the respective associated sections 112a, 112b and 114a, 114b may have cooperating parts of plug and socket connections.

In use, with the rods 112, 114 set up with the described 9 feet spacing and with the outer ends of the line sections 142, 144 connected to be about 7 feet above ground, the ball 138 is suspended centrally between the two rods at a spacing of about 16 inches above the ground. A tennis player may then practice by standing behind the line 140 and hitting ball 138 which will then move outwardly away from the rods 112, 114 until resiliently brought to a halt and returned by virtue of the elastic nature of the line 140. Thus the player can readily hit the ball 138 with it being returned each time to a position for further play. There is no need for the rods 112, 114 to be completely rigid and a degree of flexibility during use of the device is not detrimental to effective use. It has been found that the manner of termination of the line sections 142, 144, because of use of the connections 150, 152 there is little friction on the line sections which might otherwise quickly wear these and cause breakage. Particularly, the loop 200 is clamped by the connector 202 so that rubbing movement between these is substantially precluded. However, if excessive stretching of material in one side of loop 200 during stressing of the line 140 in use of the device, the resultant reduction in cross-sectional area of the line material will permit some release of the clamping provided by the surfaces 240, 242 such that a slight compensating movement of the material around the element 214 will occur. Thus, the connector 202 operates to equalise loading on the two runs of line material in loop 200 between the connector and location 206.

The doubling of the line material between locations 206, 208 has also been found to provide a short length of line which has shock absorbing characteristics which assist by partly isolating heavy transient stresses in the line from loop 200. The interconnection between portion 146a of line section 146 and ball 138 provided by the leater portion 146b has been found to be advantageous since this minimises the extent of contact by a player's racquet with the elastic portion of this line section which might otherwise quickly wear the rubber and likewise cause breakage.

The described construction has been advanced merely by way of explanation and many modifications could, of course, be made thereto. For example, whilst experience has shown that the indicated dimensions for the various parts of the device and their relative spacings are particularly effective, variations may of course be made. Again, the described means of supporting the rods 112, 114 may obviously be varied. Particularly, in permanent installations the rods may merely be set into the ground or may be constructed such that they may be removably interfitted with suitable mountings already in the ground. Such mountings may comprise sockets which can receive lower ends of the rods. Again, even where stays of the general kind described are used these may be varied in form. For example, instead of forming the stays 132 from wire as described, they could be flexible being provided with ground pegs at one end and secured to the rods at the other end.

Furthermore, the collars 118, 120 may be such that they can be moved lengthwise of the rods 112, 114. Again, the interconnections between the various line section ends and the rods and ball may be varied. Some provision for adjustment of the connections 150, 152 along the lengths of the rods may also be helpful.

The rods 112, 114 may also be supported by a flexible tie line extending between tops thereof and by two pairs of flexible lines one pair extending from the top of each rod to respective spaced ground pegs. However, the provision of such a tie line between the tops of the rods is undesirable as it can interfere with the flight of ball 138 in use of the device. In this case the collars 118, 120 and associated stays 132 may be omitted.

The portion **146*b* of line section 146** may also be formed from material other than the described leather, for example from flexible plastics material.

Figure 6:
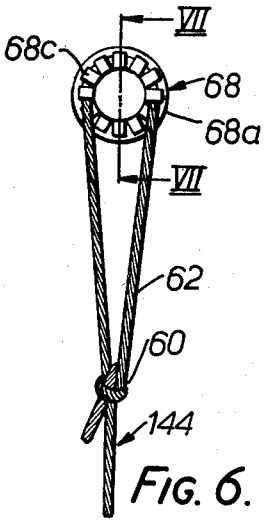
FIG. 6 is an enlarged view of an alternative form of line termination usable in the device of FIG. 1.
Figure 7:
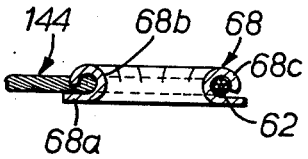
FIG. 7 is a cross-section on the line VII—VII in FIG. 6.
Figure 8:
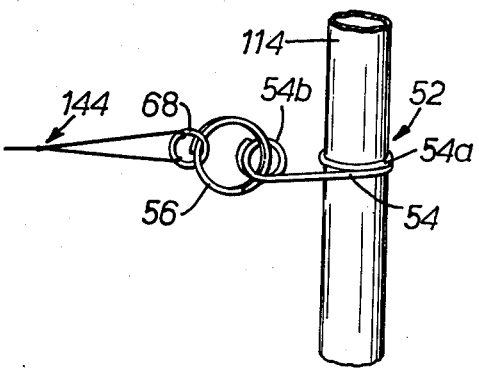
FIG. 8 is a fragmentary perspective view of an alternative line interconnection, using the line termination of FIGS. 6 and 7.

In the modified construction shown in FIGS. 6 to 8, the outer ends of the line sections 142, 144 are secured to respective rods 112, 114 by modified connections 50. Connections 50 are identical and only the connection 50 to line section 144 is shown. This includes a wire connection element 54 which has one end thereof formed into a two-turn helical loop **54*a* through which rod 114 passes, the loop firmly gripping the rod such that it will maintain a preset position along the length of the rod during use of the device but such that it can, nevertheless, be moved lengthwise of the rod by manual pressure applied in the axial direction of the rod. The other end of element 54 extends to a 1½-turn open loop portion 54*b* which permits easy removal and engagement therewithin of a ring 56 which ring may, for example, be in the form of a key ring. The other end of line section 144 is received in an eyelet 68 which is looped within ring 56. The arrangement is such that the free end of the line 144 is held in a particularly free manner being connected to the rod 114 through the intermediary of the three interengaged loops provided by ring 56 and loop portion 54*b*, and eyelet 68**.

The outer end of line section 144 is connected to eyelet 68 by first tying the end with a knot 60 to form an end loop 62. The eyelet 68 is positioned at the extreme end of the loop 62 with this end lying on a peripheral flange portion **68*a*** and passing around about half of an upstanding annular collar.

The line 140 is, in the described construction formed from a single length of the aforementioned rubber material, end portions thereof forming the line sections 142, 144 and inner ends of these portions being knotted together so that portion **146*a* of section 146 is formed by a loop, the knot then comprising the junction 148. As best shown in FIG. 2 the resultant double length of material forming portion 146*a* is looped through itself and through the loop of material forming section portion 146*b***.

The formation of the line 140 as a single length is very important; experiments have shown that failure of lines of the general form shown will readily occur if great care is not taken in the manner of terminating the line sections. For example, if the third line section is formed from a piece of elastic material separate to the first and second sections and simply tied thereto, the stress induced by the tie will lead to very quick failure of the line at that location. On the other hand, with the described method of knotting, failure of the line at the junction between the third line sections is rare. It will be appreciated that the line material used is quite fine and will in any event fail eventually through fatigue. With the described method of forming the line, the line will usually withstand several hours of substantially continuous use whereas if proper care is not taken in forming the line, it will almost invariably fail within a matter of twenty minutes—failure usually occurring at the terminations of the first and second sections and at the location where the third section joins the first and second sections. Again, if a knot is used to tie the line to the leather loop **146*b***, failure can similarly be expected to occur at this point.

Whilst the described device is designed for tennis practice, it can readily be adapted for practicing other games such as squash.

I claim:

1. A ball game practice device comprising a ball, a line having first, second and third sections extending from a common junction to respective outer ends thereof, at least said first and second sections being formed of elastic material, two elongate members positionable to extend from a ground surface in upright spaced disposition, first and second connection means for connecting outer end portions of the first and second sections to respective elongate members, and an outer end portion of the third section being connected to said ball whereby, in use of the device with the elongate members positioned in said upright spaced disposition and the outer end portions of said first and said second sections connected to the respective elongate members by said connection means, the ball is then suspended from the junction of said first and said second sections through said third section; outer end portions of the material forming said first and second line sections being formed into respective loops, said first and second connection means each comprising a separate plastics body, said plastics bodies having respective cylindrical surfaces of substantially less circumferential dimension than the unstretched lengths of the material forming the said loops and the said loops being engaged around respective ones of said cylindrical surfaces, said bodies further including respective retaining portions preventing the said loops from becoming disengaged from the said cylindrical surfaces; said bodies having respective apertures therethrough and said first and second connection means further including respective rings which pass through respective said apertures and through respective openings in connection portions of the respective ones of said two elongate members.

2. A device as claimed in claim 1, wherein said apertures of said bodies have a greater dimension than the cross-sectional dimension of said rings which pass therethrough.

3. A device as claimed in claim 2, wherein the rings are substantially rigid, with the cross-sectional size of the apertures of said bodies being at least several times the cross-sectional size of the rings.

4. A device as claimed in claim 1, claim 2, or claim 3, wherein each said retaining portion is arranged to present a concavely curved surface which extends around, and in generally parallel spaced relationship to, a respective cylindrical surface, and a pair of opposed surfaces extending transversely to the axial direction of the respective cylindrical surface; the transversely extending surfaces bridging the curved surface and cylindrical surface so that each said body defines a circular tunnel, said tunnel having a side aperture, formed through the curved surface; each said loop extending, from a respective location at which it joins to the remainder of its line section, into a respective tunnel through the aperture thereof, around said cylindrical surface, exteriorally of that tunnel, and through the aperture thereof and thence back to said location.

5. A device as claimed in claim 4, wherein each said tunnel is of sufficient size that it lightly clamps the material forming the associated loop where that material is within the tunnel, when the material is unstretched, but is such that, when the material undergoes dimensional change in cross-section pursuant to stretching thereof, such clamping is at least partly released.

6. A device as claimed in claim 5, wherein each said body includes first and second parts of which said first part has a respective one of said apertures formed therein and has a respective cylindrical surface formed therearound concentrically with the aperture, and said second part being of annular form and fitted to one end of said first part; said first part having an outwardly extending flange at the end opposite said second part such that a respective said pair of surfaces are defined as opposed facing surfaces on the said flange and second part, and one of said second part and flange having a peripheral rim defining a respective said curved surface, which rim bridges said flange and second part.

7. A device as claimed in claim 6, wherein said rim is on said second part and has a discontinuity so that it extends substantially, but not completely, around the periphery of the second part whereby in the assembled condition of the first and second parts, a respective side aperture is defined at the location where the discontinuity in said rim is present.

8. A device as claimed in claim 7, wherein said first and second parts of each body form cooperating components of a snap fastener so that said loops are positionable over respective cylindrical surfaces and the bodies assembled by snapping said second parts onto the first parts.

9. A device as claimed in claim 8, wherein each said first part has, at the end remote from said flange, at least one outward projection over which a central opening of the second part must pass to engage the first and second parts together, the central opening being of such dimension that it can only be passed over said projection by elastic deformation of at least one of said first and second parts, but reverts to its undeformed state upon such passing over.

10. A device as claimed in claim 9, wherein each said projection is in the form of a peripheral ridge.

11. A device as claimed in claim 10, wherein the spacing between each said ridge and said flange is such as to effect said clamping of the loop in the assembled body by pressing of the respective said opposed facing surfaces against the loop material.

12. A device as claimed in claim 1, wherein the third line section includes a flexible, non-elastic element which interconnects the ball and the remainder of third section.

13. A device as claimed in claim 12, wherein said ball is a tennis ball having an outer nap and the nonelastic element is in the form of a loop having a portion thereof passing through the nap of the ball, but not into the interior of a casing of the ball, and wherein said third line section includes an elastic portion positioned between the common junction and the inelastic portion.

14. A device as claimed in claim 1, wherein said loops are formed in said end portions of the material forming said first and second line sections by tying each such end portion back upon itself at two locations so that the material forming said first and second line sections in each case extends from the associated first location to the second location, around the respective loop to the second location and thence back to the first location, the first and second locations being relatively closely spaced together compared with the half length of the loops, the first and second line sections being formed from a single strand of line material which is doubled between the said first and second locations by virtue of said tying.

15. A device as claimed in claim 14, wherein the first and second sections and at least a part of the third section extending from the junction between the sections are formed from a single length of latex rubber line material, the third section being formed as a centre loop in a central portion of the line material, the centre loop being formed by folding the line material substantially at its mid-point, so that it is doubled, and tying the doubled line material at a point between the ends thereof, portions of the line material extending from this tie point to and including the end loops then defining the first and second sections.

16. A device as claimed in claim 1, wherein said elongate members are each provided at lower ends thereof with a coupling permitting affixment thereof to a ground surface, the coupling comprising means presenting a plurality of stay-receiving apertures arrayed about the axis of the respective elongate member and a plurality of stays of rodlike form each having two hooked end portions so that one said hooked end portion can be passed into a stay-receiving aperture with the portion of the stay between the end portions extending generally radially of the member to permit the other hooked end portion to be pressed into a ground surface, to support the elongate member.

* * * * *